US011109656B2

(12) United States Patent
Sanchez

(10) Patent No.: US 11,109,656 B2
(45) Date of Patent: Sep. 7, 2021

(54) JEWELRY CASE

(71) Applicant: Dusty Sanchez, Los Lunas, NM (US)

(72) Inventor: Dusty Sanchez, Los Lunas, NM (US)

(73) Assignee: MEDORA DESIGNS, LLC, Peralta, NM (US)

( * ) Notice: Subject to any disclaimer, the term of this patent is extended or adjusted under 35 U.S.C. 154(b) by 0 days.

(21) Appl. No.: 16/908,541

(22) Filed: Jun. 22, 2020

(65) Prior Publication Data

US 2020/0397107 A1 Dec. 24, 2020

Related U.S. Application Data

(60) Provisional application No. 62/865,118, filed on Jun. 21, 2019.

(51) Int. Cl.
*A45C 11/16* (2006.01)
*A47F 7/02* (2006.01)
*A45C 13/02* (2006.01)

(52) U.S. Cl.
CPC ..... *A45C 11/16* (2013.01); *A47F 7/02* (2013.01); *A45C 13/02* (2013.01)

(58) Field of Classification Search
CPC ..... A45C 11/16; A45C 13/02; A47F 7/02
USPC ..... 206/6.1, 566; 220/521, 522, 553, 555; 211/85.2
See application file for complete search history.

(56) References Cited

U.S. PATENT DOCUMENTS 1,059,561 A 4/1918 Parks
1,456,613 A 5/1923 Bartels
2,559,289 A * 7/1951 Eisen ..... A45C 11/16 312/291
3,930,702 A 1/1976 Pichowicz
4,016,972 A 4/1977 Szamborski
4,120,394 A * 10/1978 Soltes ..... A45C 11/16 206/19
D259,154 S 5/1981 White, Jr. et al.
4,413,736 A 11/1983 Nibling
D292,175 S 10/1987 Wolf
5,141,300 A 8/1992 Ciesla
5,246,103 A 9/1993 Hicks
5,253,750 A 10/1993 Keffer
5,511,873 A 4/1996 Mech
5,931,319 A 8/1999 Murphy
6,361,130 B1 * 3/2002 Kardy ..... A47B 81/00 211/85.2
6,685,023 B2 2/2004 Bleggi et al.
D525,030 S 6/2006 Farmer
7,367,449 B2 5/2008 Kaminski et al.
7,389,868 B2 6/2008 Lewand et al.
D582,189 S 12/2008 Peterson
D631,251 S 1/2011 Hong
(Continued)

FOREIGN PATENT DOCUMENTS

ES 1074133 Y 6/2011
FR 2411540 A7 7/1979
(Continued)

*Primary Examiner* — Luan K Bui

(74) *Attorney, Agent, or Firm* — Kramer Law Firm, P.C.; Kameron W. Kramer

(57) ABSTRACT

A jewelry case that is portable, secure, prevents tangling, inexpensive, and easy to use, comprising a box containing a plurality of display surfaces and indentations, and a lid containing a plurality of compression bars.

4 Claims, 4 Drawing Sheets

(56) References Cited

U.S. PATENT DOCUMENTS

| | | | | |
|---|---|---|---|---|
| D637,012 | S | 5/2011 | Lu | |
| 7,946,424 | B2 | 5/2011 | Gupta | |
| 8,881,441 | B2 | 11/2014 | Thornton | |
| 9,516,957 | B2 | 12/2016 | Riegle | |
| 9,723,904 | B1 | 8/2017 | Taylor | |
| 10,477,991 | B1 * | 11/2019 | Fragala | A47F 7/03 |
| 2004/0154935 | A1 * | 8/2004 | Kaminski | A45C 13/10 206/6.1 |
| 2004/0159560 | A1 | 8/2004 | Viverito | |
| 2005/0093405 | A1 * | 5/2005 | Greiner | A47F 5/03 312/321.5 |
| 2008/0197028 | A1 | 8/2008 | Cerato | |
| 2012/0068582 | A1 * | 3/2012 | Elderkin | E05B 47/004 312/7.1 |
| 2014/0353177 | A1 | 12/2014 | Senate | |
| 2015/0113846 | A1 * | 4/2015 | Nicholson | A45C 11/16 40/723 |
| 2017/0112247 | A1 * | 4/2017 | Pendergrass | A45C 11/16 |

FOREIGN PATENT DOCUMENTS

| | | | |
|---|---|---|---|
| JP | 3179683 | B2 | 6/2001 |
| KR | 19990037692 | U | 10/1999 |

* cited by examiner

JEWELRY CASE

CROSS-REFERENCE TO RELATED APPLICATION

This application claims the benefit of U.S. Provisional Patent Application Ser. No. 62/865,118 filed Jun. 21, 2019, titled "Jewelry Case" and the subject matter thereof is incorporated herein by reference thereto.

TECHNICAL FIELD

The present invention relates generally to a jewelry case, and more particularly to a jewelry case that securely holds and displays necklaces and other jewelry.

BACKGROUND ART

Jewelry cases are well-known in the prior art. Typically, there are two types of jewelry cases: display or storage. While there are numerous jewelry cases that attempt to offer both features, there are shortcomings contained in the prior art.

The challenge that much of the prior art has faced is how to prevent tangling of jewelry, while still securing items in a way as to be easily seen and displayed. The approach taken to these challenges in the prior art usually takes the form of hanging necklaces and chains, and/or having smaller divided compartments or pouches to maintain separation of items. There are several disadvantages to both approaches Many traditional jewelry cases require the necklaces to hang freely. U.S. Pat. No. 9,516,957 B2, Riegle, entitled "Jewelry Case with Many Viewable Spaces and Removable Sections," U.S. Pat. No. 9,723,904 B1, Taylor, entitled "Jewelry Storage System and Method of Use," U.S. Pat. No. 7,389,868 B2, Lewand et al, entitled "Jewelry Security Organization and Storage Device," are just a few of the patents that disclose jewelry organization cases whereby the necklaces hang. However, each of these inventions require the jewelry cases to remain in the upright standing position whenever it contains jewelry, otherwise the jewelry will move around.

Another approach to these challenges has been to have smaller compartments within a jewelry case. While this can eliminate co-mingling, it does not prevent shifting of the items or prevent items from tangling with themselves. This approach can also take up considerable space.

None of the prior art fully addresses the problems resolved by the present invention. The present invention overcomes these limitations contained in the prior art by providing a jewelry case that is portable, secure, inexpensive, easy to use, prevents tangling of necklaces and bracelets, and keeps jewelry safe and sound. The jewelry case of the present invention overcomes many of the shortcomings contained in the prior art. The present invention provides a jewelry case for necklaces or the like. The jewelry is held in place by compression in individual storage compartments, allowing the jewelry case to be stored vertically or horizontally, and easily transported. The present invention provides a storage solution that allows for easy viewing of the necklaces, easy access to the necklaces, prevents tangling and co-mingling of different necklaces, and allows for transportability of the necklaces and other jewelry. Certain embodiments of the invention have other steps or elements in addition to or in place of those mentioned above. The steps or element will become apparent to those skilled in the art from a reading of the following detailed description when taken with reference to the accompanying figures.

DETAILED DESCRIPTION OF THE INVENTION

Figure 1:
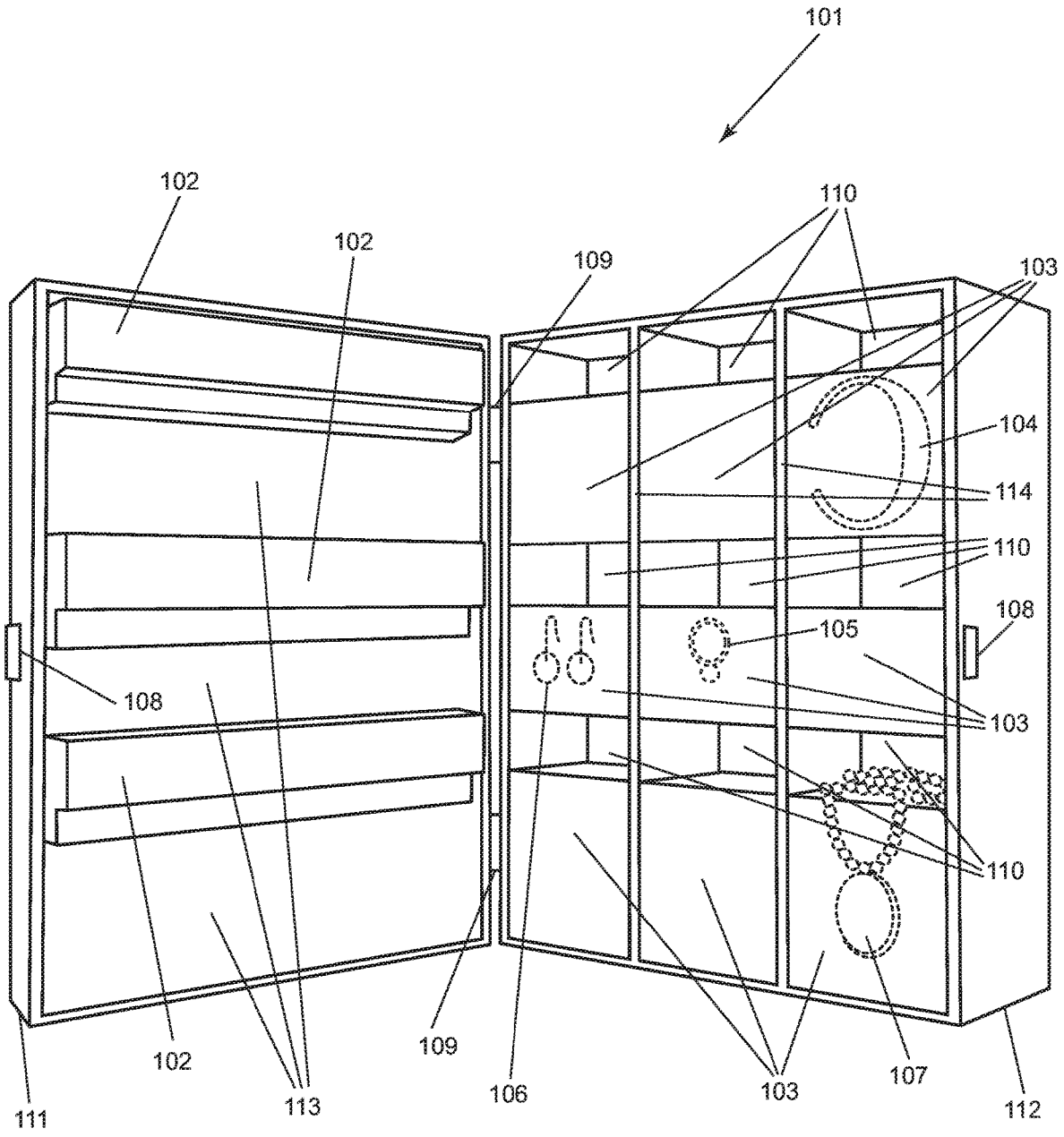
FIG. 1 is a perspective view of the jewelry case in the open position.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the jewelry case, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures.

It is noted that, as used in this specification and the appended claim(s), the singular forms "a," "an," and "the" include plural referents unless expressly and unequivocally limited to referent. Thus, for example, reference to "a compartment" includes two or more different compartments. Additionally, "plurality" means one or more. As used herein the term "include" and its grammatical variants are intended to be non-limiting, such that recitation of items in a list is not to the exclusion of other like items that can be substituted or other items that can be added to the listed items.

The present invention comprises a jewelry case that is portable, secure, inexpensive, easy to use, prevents tangling of necklaces and bracelets, and keeps jewelry safe and sound.

FIG. 1 is a perspective view of jewelry case 101 in the open position. Items of jewelry are shown disposed on display surfaces 103, including, bracelet 104, ring 105, earrings 106, and necklace 107. Compression bars 102 are disposed on lid 111. Compression bars 102 are L shaped. Lid panels 113 are transparent or semi-transparent, as so desired. Locks 108 are displaced on lid 111 and box 112 such that when the locks 108 are in contact with each other, they connect and lock in place, thus securing the jewelry case 101 in a closed position. Box 112 comprises indentations 110, display surfaces 103, and dividers 114. Lid 111 and box 112 are securably attached via hinges 109.

Lid 111 is comprised of lid panels 113. Lid panels 113 can be all one piece, with the compression bars 102 disposed directly on the lid panels 113, or lid panels 113 can be separate pieces, forming the entirety of the lid 111 along with the compression bars 102.

Figure 2:
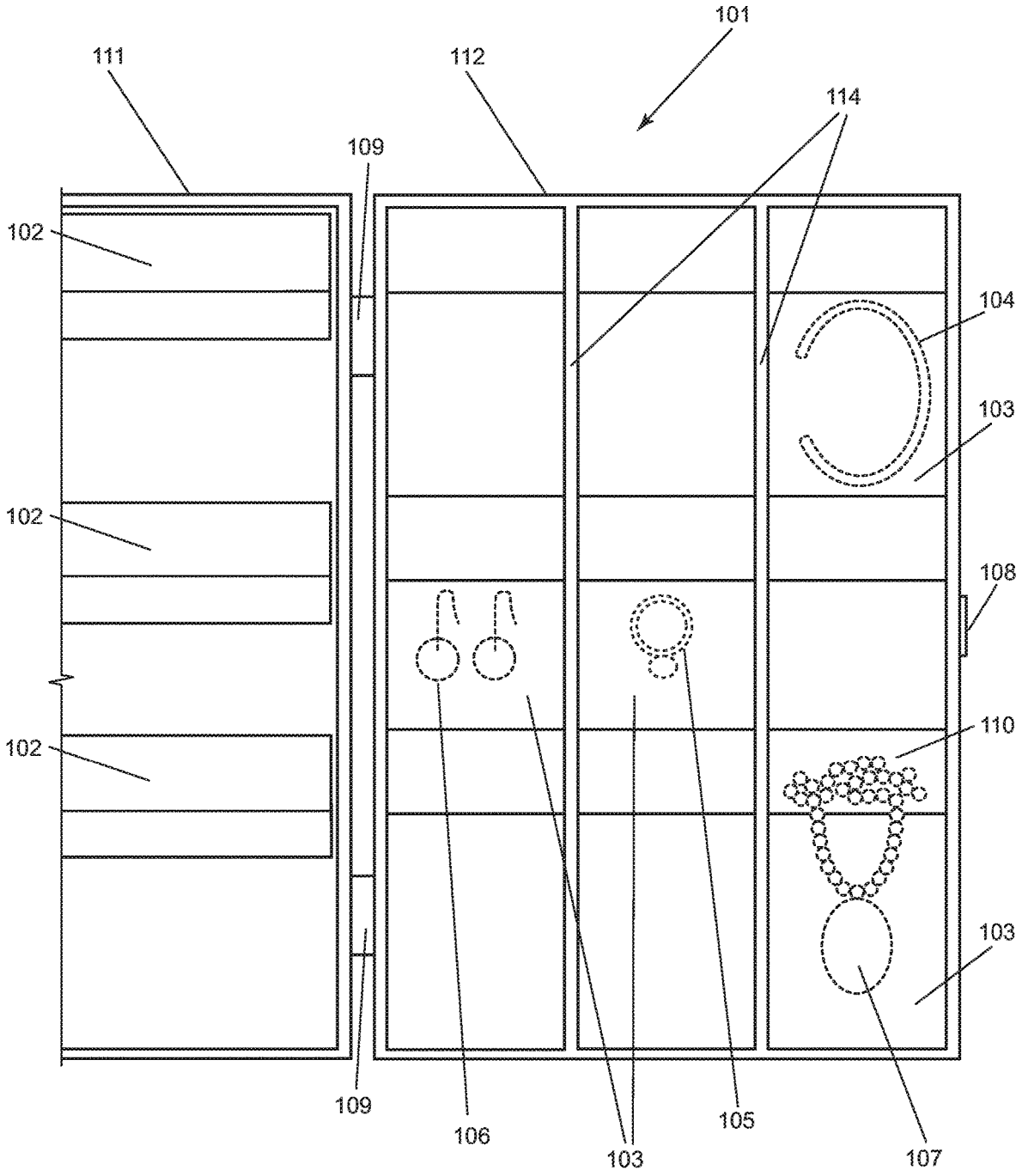
FIG. 2 is a partial front view of the jewelry case in the open position.

FIG. 2 is a partial front view of jewelry case 101 in the open position. Items of jewelry are shown disposed on display surfaces 103, including, bracelet 104, ring 105, earrings 106, and necklace 107. Compression bars 102 are disposed on lid 111. Lock 108 is shown on box 112.

Figure 3:
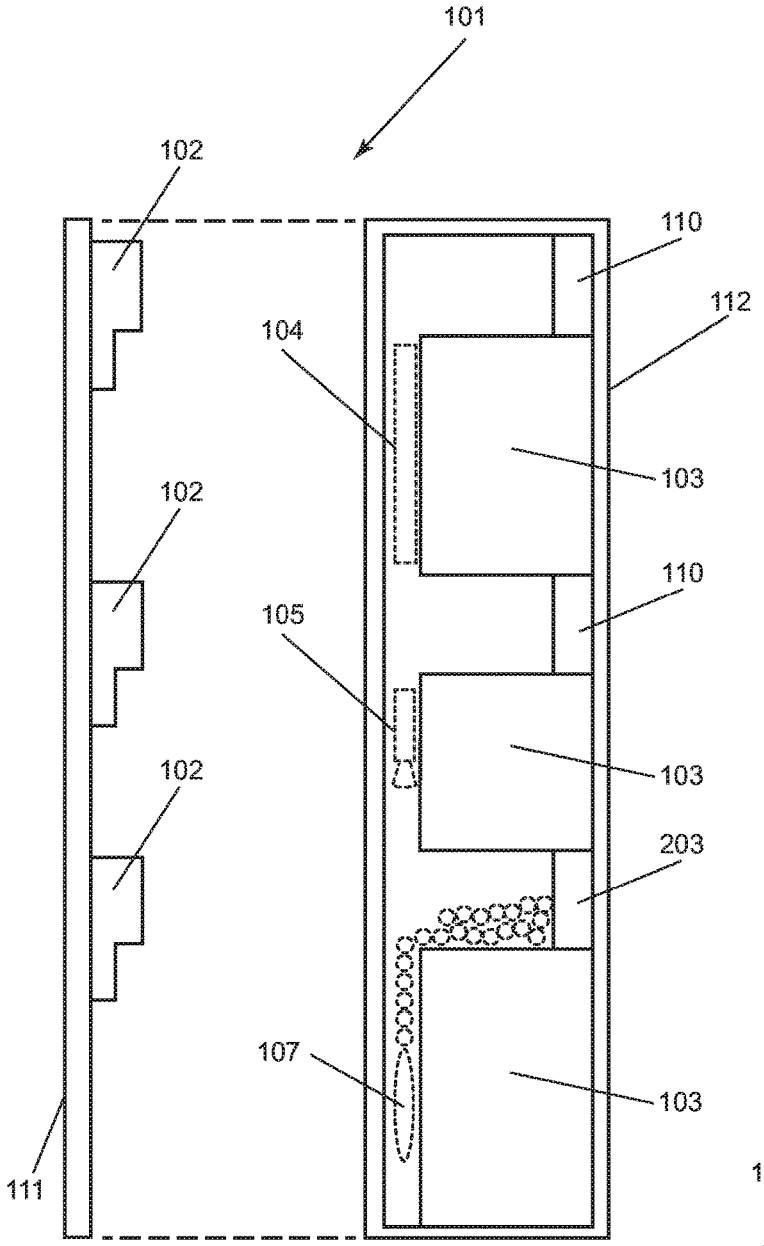
FIG. 3 is a side view cut away of the jewelry case showing the lid and box.

FIG. 3 is a side view cut away of jewelry case 101 showing lid 111 and box 112. Compression bars 102 are aligned with indentations 110 and display surfaces 103. Compression bars 102 can vary in size such that the part of compression bars 102 that extend into the void created by the display surfaces 103 and indentations 110 can create a smaller void or larger void, depending on the desired need.

Figure 4:
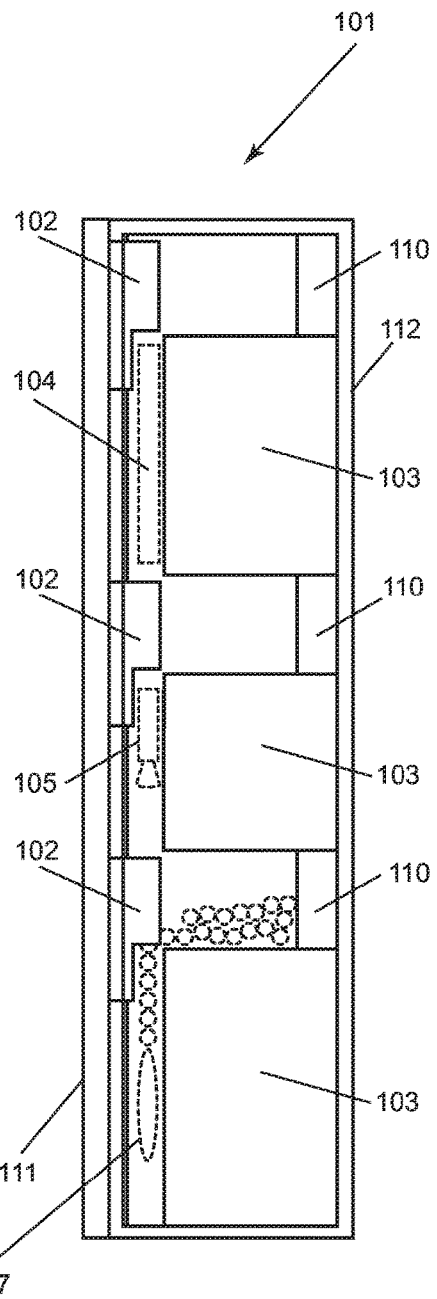
FIG. 4 is a side view cut away of the jewelry case in the closed position.

FIG. 4 is a side view cut away of jewelry case 101 in the closed position. Compression bars 102 are in direct contact with bracelet 104, ring 105, and necklace 107, thus securing them in place between compression bars and display surfaces. The chain of necklace 107 is placed in indentation 110, while the pendant or other piece of necklace 107 is on displace surface 103. Jewelry can be placed on the display surfaces 103 such that the portions of the jewelry that are not either in contact with the compression bars 102 or in indentations 110 are easily visible through the lid panels 113 (not seen in this view).

Compression bars 102 are comprised of a pliable material, such as, including, but not limited to, foam.

Figure 5:
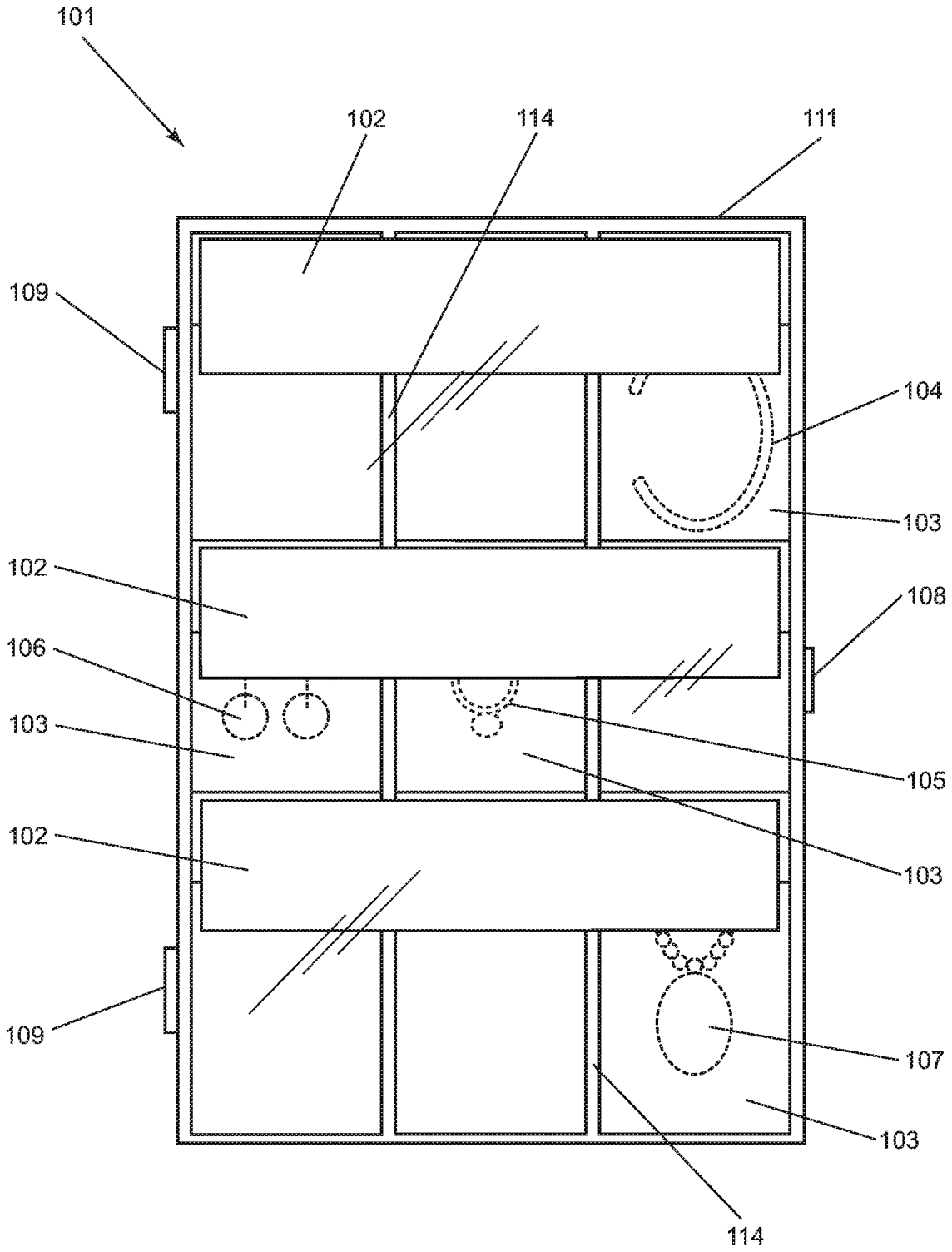
FIG. 5 is a front view of the jewelry case in the closed position.

FIG. 5 is a front view of jewelry case 101 in the closed position. Portions of bracelet 104, ring 105, earrings 106, and necklace 107 are each visible to the user and secured, thus allowing the jewelry case 101 to be transported, stored in any orientation, etc.

The compression feature of the present invention allows the jewelry case 101 to be stored vertically, like a book on a shelf, while holding the jewelry or items securely and preventing tangling and co-mingling. The items would still be easily viewed through a transparent or semi-transparent lid. This takes up much less space than many previous jewelry cases and is appears less conspicuous. It could easily be slipped into a drawer or be packed for travel.

Locks 108 can consist of any type of locking mechanism, including, but not limited to, key lock, pad locks, etc. In one embodiment of the present invention, locks 108 can simply be a securing mechanism that does not actually lock, but it securably attached lid 111 to box 112.

In one embodiment of the present invention, lid 111 and box 112 are not securably. Instead, they are separate pieces that attach via locking or other attachment means.

In one embodiment of the present invention, indentations 110 comprises a means for further securing chains of necklaces, bracelets, etc.

In one embodiment of the present invention, dividers 114 are not present.

In one embodiment of the present invention, compression bars 102 are such that part of the indentations 110 is visible to the user when the jewelry case 101 is in the closed position.

In one embodiment of the present invention, lid panels 113 are not transparent.

In one embodiment of the present invention, compression bars 102 are not securably attached to lid 111, but instead are attached in some other manner that allows for them to be securely placed in contact with display surfaces 103.

In one embodiment of the present invention, the are no compression bars, but instead, the lid is in direct contact with display services 103.

Compression bars 102, display surfaces 103, and indentation 110 can vary in size, shape, number, material, etc., throughout the jewelry case 101. Jewelry case 101 can have any number of rows and columns of display surfaces 103 and can vary in size and other characteristics throughout.

The jewelry case 101 is simply to use. Jewelry is place on the display surfaces 103, with any excess chains or the like placed onto indentations 110. The jewelry is placed on the display surfaces 103 such that compression bars 102 will be in direct contact with a portion of the jewelry once the jewelry case 101 is closed.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying drawings are to be interpreted in an illustrative and non-limiting sense.

What is claimed is:

1. A jewelry case comprising:

a box containing a plurality of display surfaces and indentations; and a lid containing a plurality of compression bars, each of the plurality of compression bars includes an L shape having a first portion adapted to be arranged facing the associated indentation, and a second portion arranged perpendicularly to the first portion and adapted to be arranged facing the associated display surface, wherein the second portion is adapted to abut an item of jewelry to secure the item of jewelry between the compression bar and the display surface.

2. The jewelry case of claim 1 further comprising any number of hinges securably attaching the box to the lid.

3. The jewelry case of claim 1 further comprising a transparent or partly transparent lid.

4. The jewelry case of claim 1 further comprising a locking mechanism, securing the box to the lid.

* * * * *